US005301948A

United States Patent [19]

Hundley

[11] Patent Number: 5,301,948

[45] Date of Patent: Apr. 12, 1994

[54] GOLF SWING TRAINING DEVICE

[76] Inventor: Edward A. Hundley, Rte. 12, Box 305, New Braunfels, Tex. 78132

[21] Appl. No.: 52,103

[22] Filed: Apr. 22, 1993

[51] Int. Cl.[5] ..... A63B 69/36

[52] U.S. Cl. ..... 273/191 R

[58] Field of Search ..... 273/191 R, 191 A, 191 B, 273/192, 186.2; 434/252

[56] References Cited

U.S. PATENT DOCUMENTS

| | | | |
|---|---|---|---|
| 2,737,432 | 3/1956 | Jenks | 273/191 R X |
| 3,604,712 | 9/1971 | Prior | 273/186 |
| 4,261,573 | 4/1981 | Richards | 273/191 |
| 5,139,264 | 8/1992 | Wooten | 273/191 R |
| 5,156,402 | 10/1992 | Hart | 273/191 |
| 5,242,344 | 9/1993 | Hundley | 273/191 R X |

*Primary Examiner*—George J. Marlo
*Attorney, Agent, or Firm*—Gunn, Lee & Miller

[57] ABSTRACT

A golf swing training device which is used by both amateur and professional golfers to develop and maintain a proper golf swing. The golf swing training device not only forces the user to maintain one swing plane, but also allows the golfer to imitate the hand movement used in a proper golf swing, as well as allowing for the full extension of the golfer's arms in the follow through. Additionally, the golf swing training device develops the proper muscle groups for golfing.

10 Claims, 9 Drawing Sheets

GOLF SWING TRAINING DEVICE

BACKGROUND OF THE INVENTION

1. Field of the Invention

Applicant's invention relates to an improved golf swing training device for amateur and professional golfers to assist in developing and maintaining a proper golf swing, as well as developing the muscles associated with a proper golf swing.

2. Background Information

The most fundamental aspect to becoming a good golfer is obtaining and maintaining a golf swing that remains in one plane from back swing to follow through. This plane is generally called the "swing plane". Slicing, hooking, and generally mis-hitting the ball result from not maintaining the swing plane throughout the entire golf swing. FIGS. 1 and 3 illustrate the hand and club head movement of a proper golf swing from a frontal perspective. In a proper swing, each point representing the club head lies in the swing plane (S). FIG. 2 illustrates the imaginary line about which the swing plane (S) rotates.

As shown in FIG. 2, swing plane (S) rotates about an imaginary line (L) extending from the golfer's shoulders to the ball. The angle alpha ($\alpha$) of the swing plane is determined by the golfer's physique and club length. If the golfer is tall, he will normally stand closer to the ball. Consequently, $\alpha$ will be larger or closer to a 90 degree angle. On the other hand, if the golfer is short, he most likely will stand further away from the ball. Therefore, $\alpha$ will be smaller.

As shown in FIG. 1, during the back swing, the golfer's hands move in a circle about a point somewhere in the upper part of the chest. At the top of the back swing, this point moves from the golfer's right to his left. Accordingly, the golfer's hands describe one near circle arc on the upswing and a different near circle arc during the downswing of the back swing. Yet, the club head remains in one swing plane (S). Due to this hand movement, a golf swing training device must reproduce the two different arcs the hands track during the back swing with the same natural movement found when swinging a golf club. It must also assure throughout this movement that the club head remains in swing plane (S).

In addition to the two different arcs in the back swing as illustrated in FIG. 1, FIG. 3 illustrates that during the follow through the hands and club head are extended further than at any point during the back swing. This extension is due to the golfer's body rotating toward the target prior to the time of impact and during the follow through. Thus, the club head travels on one elliptical path on the back swing and a larger, more extended elliptical path on the follow through. Yet, both elliptical paths remain in the same swing plane (S). Consequently, the device must not only maintain swing plane (S), it must maintain swing plane (S) while allowing the complete extension of the arms and club head in the follow through.

Obtaining and maintaining a proper golf swing takes practice. Most golfers do not have time to travel to the golf course and practice/play golf every day. Furthermore, without proper coaching or feedback, repeatedly swinging a golf club does not assure the golfer is maintaining one swing plane. Several golf swing training devices have heretofore been developed which enable a golfer to practice his swing at a more convenient place or time. Some of these devices address maintaining one swing plane. Yet, none of the devices developed thus far maintain one swing plane and track the path that the hands and club head make throughout the entire golf swing without complicated and expensive telescoping mechanisms.

Therefore, a need exists for not only a golf swing training device that maintains one swing plane, but an improved device that is capable of tracking the true and realistic movement of the hands and club head throughout the entire golf swing without complicated and expensive telescoping mechanisms. The device should also be affordable so that any golfer may purchase one for his home or office.

SUMMARY OF THE INVENTION

The golf swing training device may be used by any golfer, whether professional or amateur. It assists in the development and maintenance of the proper swing action as well as in strengthening the muscles used in golfing.

In accordance with this invention, a swing element is attached to a swing plane adjuster element which is attached to a base element. Various constructions of the base element are available depending on where the device will be used. In one embodiment, the base element is securely attached to the floor, ground or other mounting surface positioned on the ground. In a second embodiment, the base element is securely fastened to a wall. In a third embodiment, the base element is attached to a pole already securely attached to a mounting surface. All embodiments of the base element are adjustable in accordance with the golfer's height.

To accommodate the individual swing planes of each user, the swing plane adjuster element adjustably attaches to the base element. The availability of accommodating different swing planes is an important aspect of the Applicant's invention. If a person practices a swing plane that is too horizontal, it will result in loss of club head speed, distance and accuracy. On the other hand, a swing plane that is too steep will result in a weak, choppy stroke.

The swing element is comprised of five connected shafts. The manner in which the shafts are connected allow the user to repeatedly reproduce the two different arcs the hands track during the back swing, as well as the necessary extension in the follow through.

A counter balance is adjustably connected to the top of the swing element. The counter balance has various utilities in that it helps assure the user of the golf swing training device completes the follow through movement, and may also be shifted up the fifth shaft of the swing element for developing the muscles required in golfing.

It is, therefore, an object of the present invention to provide a golf swing training device that is capable of reproducing the actual movement of the hands and club head.

It is a further object of the present invention to provide a golf swing training device that maintains the golf swing in one plane.

It is a further object of the present invention to be adjustable to accommodate for a user's height and individual swing plane.

It is a further object of the present invention to supply an affordable device for use at home or the office, thus eliminating the necessity to travel to the golf course to practice.

It is a further object of the present invention to provide a golf swing training device that develops the muscles required in golf.

It is a further object of the present invention to provide a golf swing training device that allows the golfer to obtain and maintain one swing plane through muscle memory techniques.

BRIEF DESCRIPTION OF THE DRAWINGS

FIG. 1 is Prior Art and was taken from "The Search for the Perfect Swing" by Alastair Cochran and John Stobbs.

FIG. 2 is Prior Art.

FIG. 3 is Prior Art and was also taken from "The Search for a Perfect Swing" by Alastair Cochran and John Stobbs.

DETAILED DESCRIPTION OF THE PREFERRED EMBODIMENT

Figure 1:
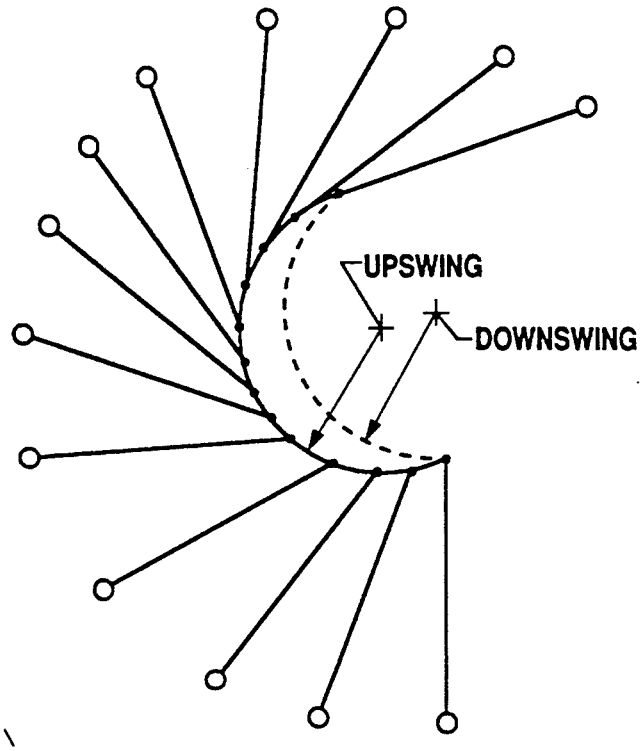
Fig. 1 (PRIOR ART)
FIG. 1 is a frontal view of the path the hands and golf head track during the upswing and downswing of the back swing.
Figure 2:
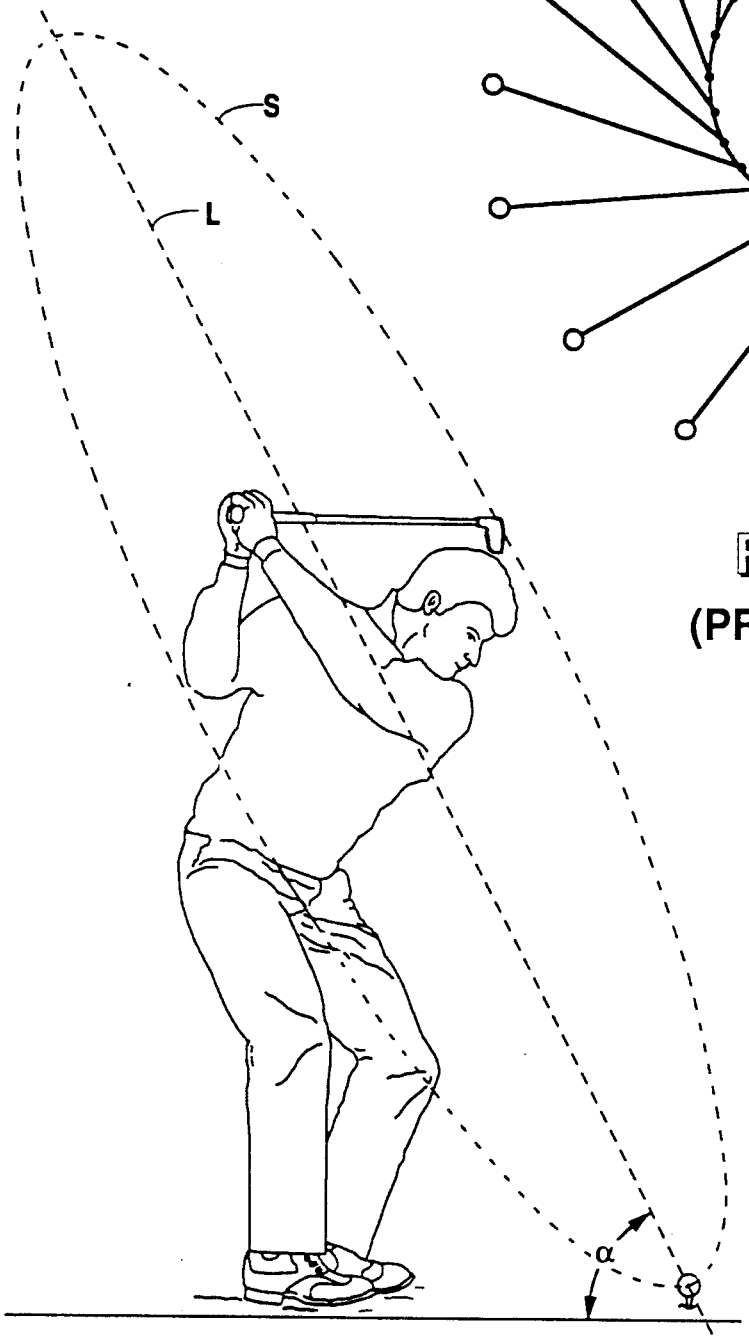
Fig. 2 (PRIOR ART)
FIG. 2 illustrates imaginary line (L) and swing plane (S).
Figure 3:
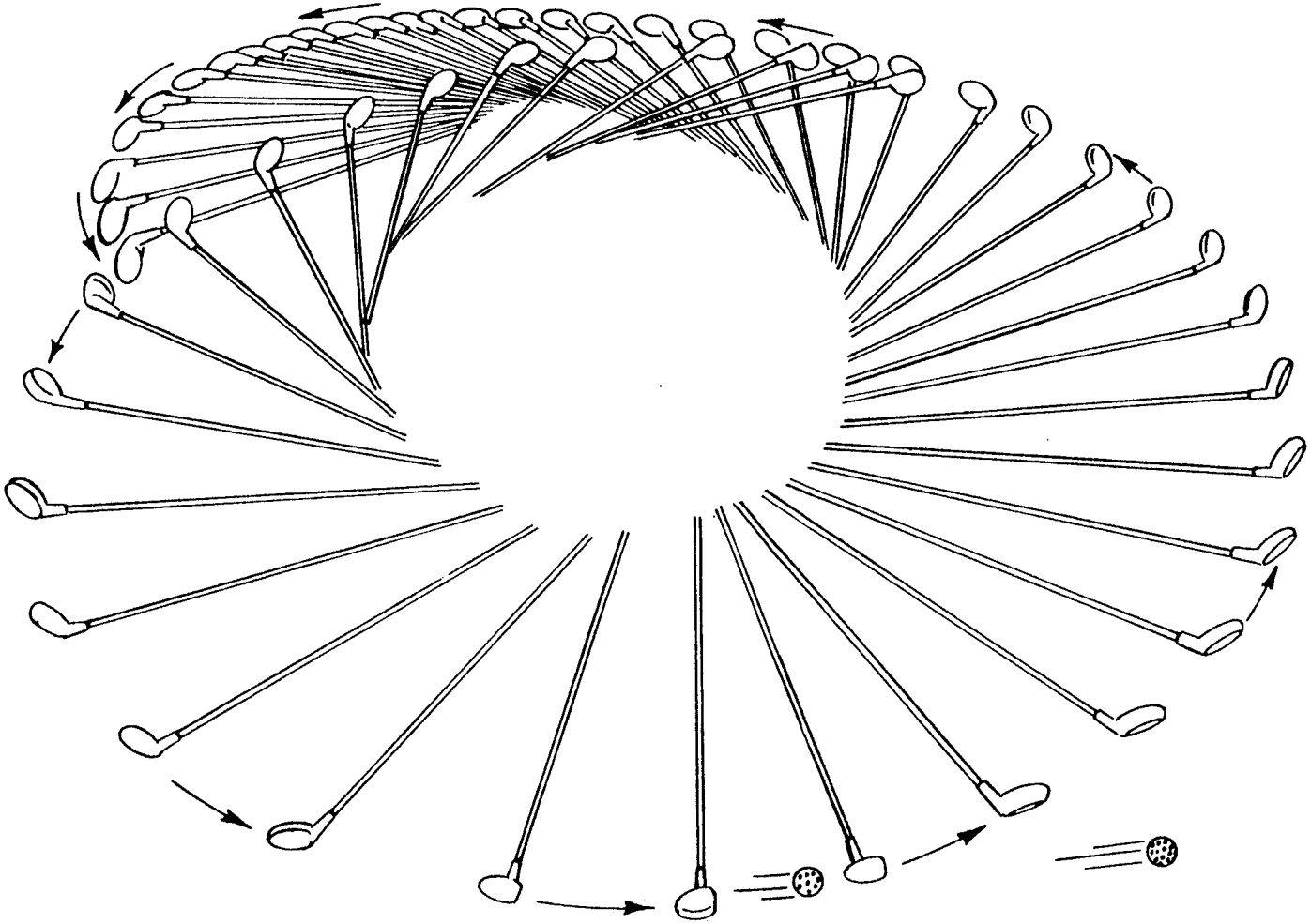
Fig. 3 (PRIOR ART)
FIG. 3 is a frontal view of the entire golf swing.
Figure 4:
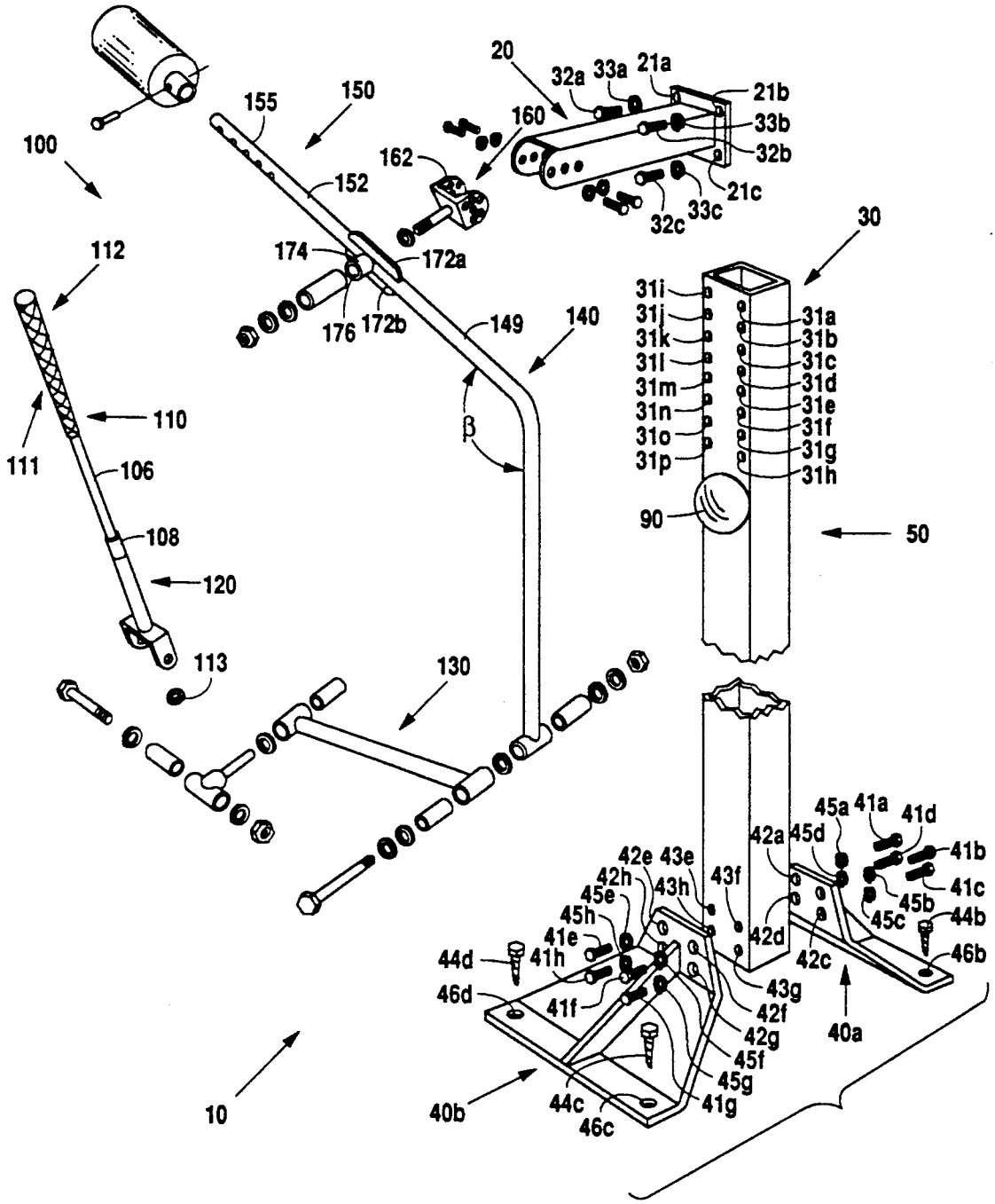
FIG. 4 is an expanded perspective view of the floor mounted version of the golf swing training device.

FIG. 4 is an expanded perspective view of the preferred embodiment of the floor mounted version of the golf swing training device (10). In all embodiments shown, swing element (100) and swing plane adjuster element (160) are the same. Only base element (50) in FIG. 4, (50') in FIG. 4A, and (50'') in FIG. 4B are modified.

Referring to FIG. 4, swing element (100) is comprised of first shaft (110), second shaft (120), third shaft (130), fourth shaft (140), and fifth shaft (150). Base element (50) is comprised of the extender element (20), height element (30), and base supports (40*a–b*). In the preferred embodiment, first shaft (110), second shaft (120), third shaft (130), fourth shaft (140), and fifth shaft (150) are made of aluminum. In other embodiments, they can also be made of composite materials such as graphite or fiberglass, or other similar material. In the preferred embodiment, extender element (20), height element (30) base supports (40*a–b*) and swing plane adjuster element (160) are made of steel. In other embodiments, they can be made of materials of similar weight and strength.

Figure 6:
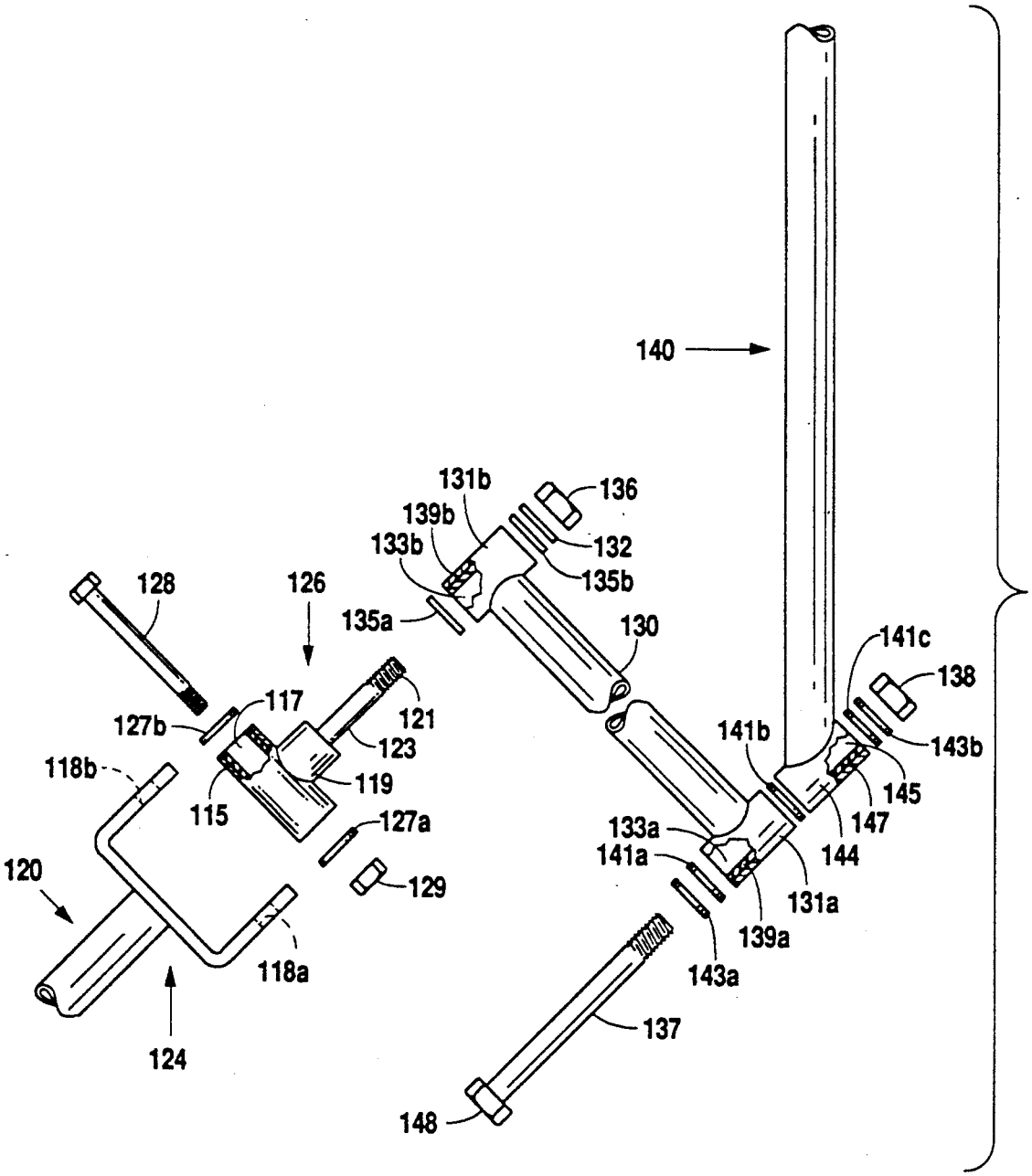
FIG. 6 is an expanded perspective view of the connections between the second shaft, universal joint, third shaft, and a portion of the fourth shaft of the swing element.
Figure 7:
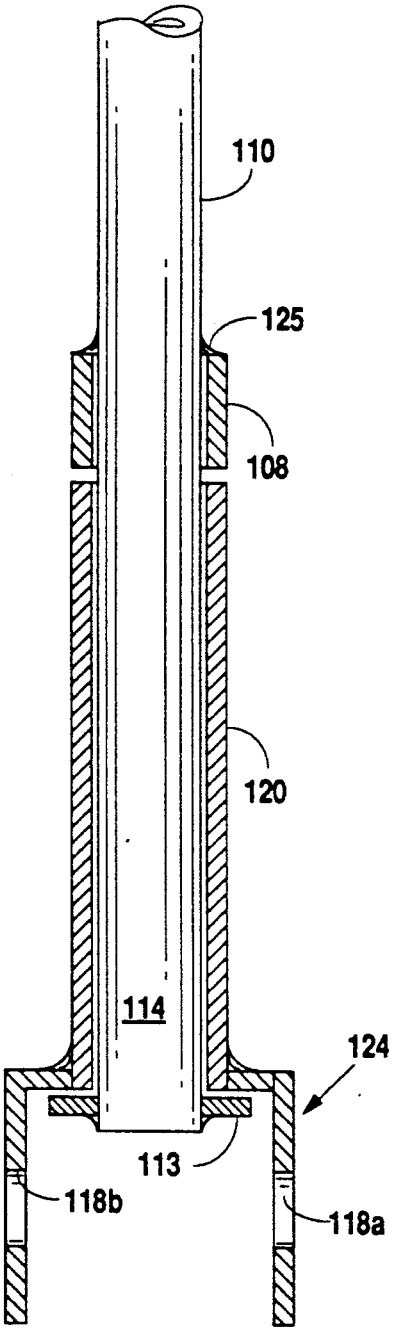
FIG. 7 is a partial cross-sectional view of the first shaft pivotally attached to the second shaft.

Upper end (112) of first shaft (110) is covered by handle (111). Handle (111) may be made of leather, vinyl, or other similar material. Referring to FIG. 6, second shaft (120) is hollow. Lower end (124) of second shaft (120) is bracketed with engagement holes (118*a–b*). Referring to FIG. 7, welded to lower end (114) of first shaft (110) is metal washer (113). Welded to approximately the mid point of first shaft (110) is tube (108). Lower end (114) of first shaft (110) is oriented inside hollow second shaft (120). This orientation is maintained by tube (108) and metal washer (113). Tube (108) bars vertical downward movement by first shaft (110) in relation to second shaft (120). Metal washer (113) restricts upwardly vertical movement by first shaft (110) in relation to second shaft (120).

As shown in FIG. 6, T-shaped head (119) with orifice (117) of universal joint (126) fits inside bracketed lower end (124) of second shaft (120). Universal joint (126) is pivotally attached to bracketed lower end (124) of second shaft (120) by aligning orifice (117) of t-shaped head (119) of universal joint (126) with engagement holes (118*a–b*) and passing threaded bolt (128) through engagement hole (118*b*), nylon thrust washer (127*b*), orifice (117) of t-shaped head (119) of universal joint (126), nylon thrust washer (127*a*) and engagement hole (118*a*). Lock nut (129) is attached to threaded bolt (128) to complete the pivotal attachment between second shaft (120) and universal joint (126). Nylon bushing (115) lines orifice (117) to assure smooth pivotal movement between second shaft (120) and universal joint (126).

Continuing with FIG. 6, both ends (131*a–b*) of shaft (130) are hollow and barrel shaped with centers (133*a–b*). Centers (133*a–b*) of ends (131*a–b*) respectively are lined with nylon bushings (139*a–b*) respectively. Extending from universal joint (126) is shaft (123) with threaded end (121). Shaft (123) fits through center (133*b*) of end (131*b*) of third shaft (130) and is held in place by lock nut (136). Nylon thrust washer (135*a*) is interposed between t-shaped head (119) of universal joint (126) and end (131*b*) of third shaft (130). Nylon thrust washer (135*b*) is interposed between end (131*b*) of third shaft (130) and metal retainer washer (132). Metal retainer washer (132) is interposed between nylon thrust washer (135*b*) and lock nut (136).

Referring to FIG. 4, approximately at the midpoint, fourth shaft (140) is bent at an angle ($\beta$). In the preferred embodiment, beta is 140 degrees. In other embodiments beta can be 130–150 degrees. Fourth shaft (140) is bent in this manner to assure fourth shaft (140) clears the user's head when golf swing training device (10) is in use.

Referring again to FIG. 6, lower end (144) of fourth shaft (140) is hollow and barrel shaped with center (145) lined by nylon bushing (147). Fourth shaft (140) is pivotally connected to third shaft (130) by threaded bolt (137) passing through center (133*a*) of end (131*a*) of third shaft (130) and center (145) of lower end (144) of fourth shaft (140) and secured in place by lock nut (138). To assure smooth pivot action, center (133*a*) is lined with nylon brushing (139*a*), center (145) is lined with nylon brushing (147), metal retainer washer (143*a*) is interposed between head (148) of threaded bolt (137) and nylon thrust washer (141*a*), nylon thrust washer (141*a*) is interposed between metal retainer washer (143*a*) and end (131*a*) of third shaft (130), nylon thrust washer (141*b*) is interposed between end (131*a*) of third shaft (130) and lower end (144) of fourth shaft (140), nylon thrust washer (141*c*) is interposed between lower end (144) of shaft (140) and metal retainer washer (143*b*), and metal retainer washer (143*b*) is interposed between nylon thrust washer (141*c*) and lock nut (138).

Figure 5:
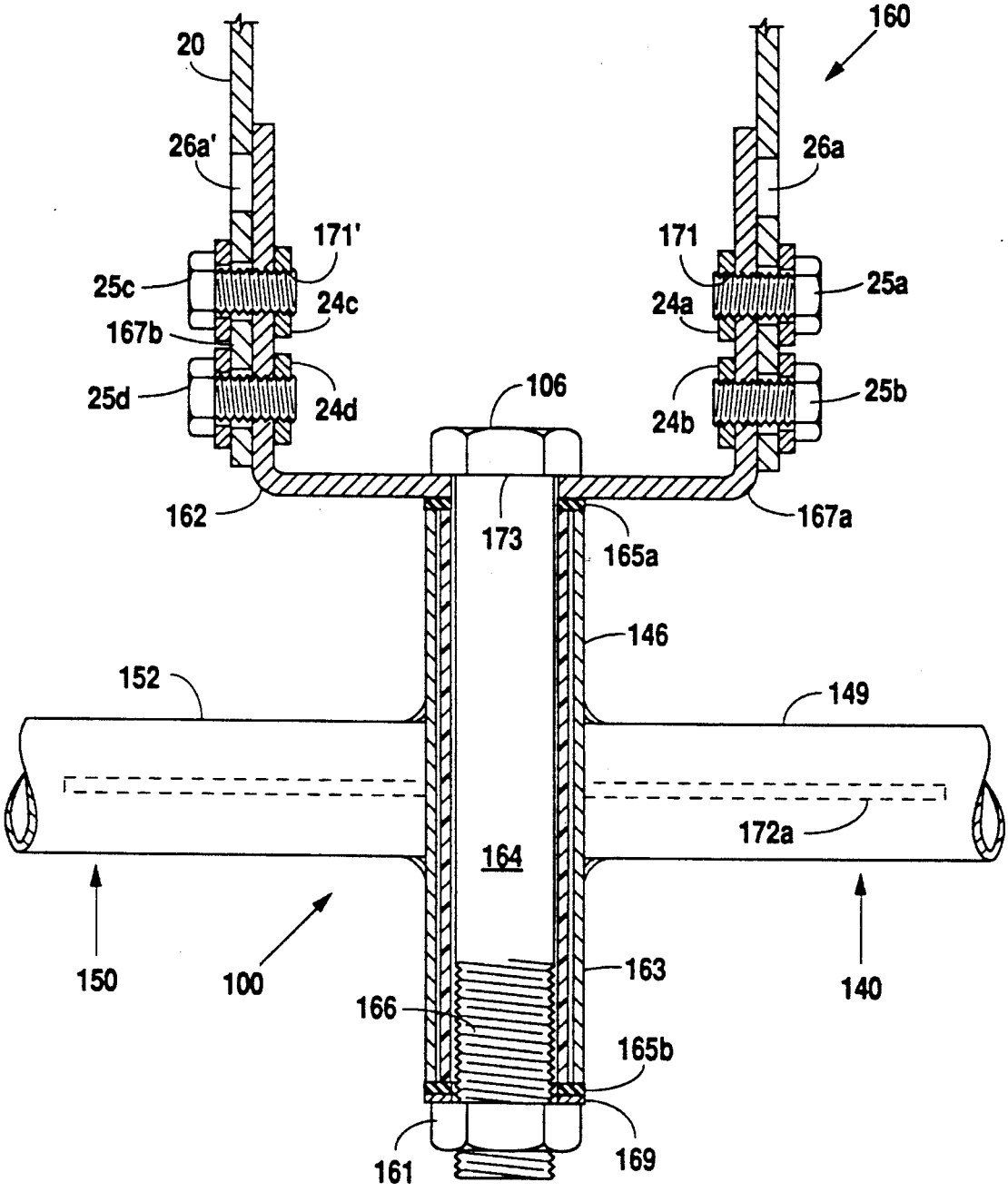
FIG. 5 is a partial cross sectional view of the swing element, swing plane adjuster element, and a portion of the base element.

As shown in FIGS. 4 and 5, the upper end (149) of fourth shaft (140) is welded to sleeve (146). Lower end (152) of shaft (150) is also welded to sleeve (146) on the directly opposite side of sleeve (146) to which upper end (149) of fourth shaft (140) is welded. Stiffner (172*a*) is welded to the upper section (174) of sleeve (146) and an equal portion of adjacent sections of upper end (149) of fourth shaft (140) and lower end (152) of fifth shaft (150). Stiffner (172*b*) is welded to the lower section (176) of sleeve (146) and equal portions of adjacent sections of upper end (149) of fourth shaft (140) and lower end (152) of fifth shaft (150). As FIG. 4 reflects, stiffner (172*a*) is oriented directly opposite stiffner (172*b*). In the preferred embodiment, stiffners (172*a–b*) are made of aluminum. In other embodiments, stiffners (172*a–b*) can be made of other materials with similar weight and strength.

Figure 8:
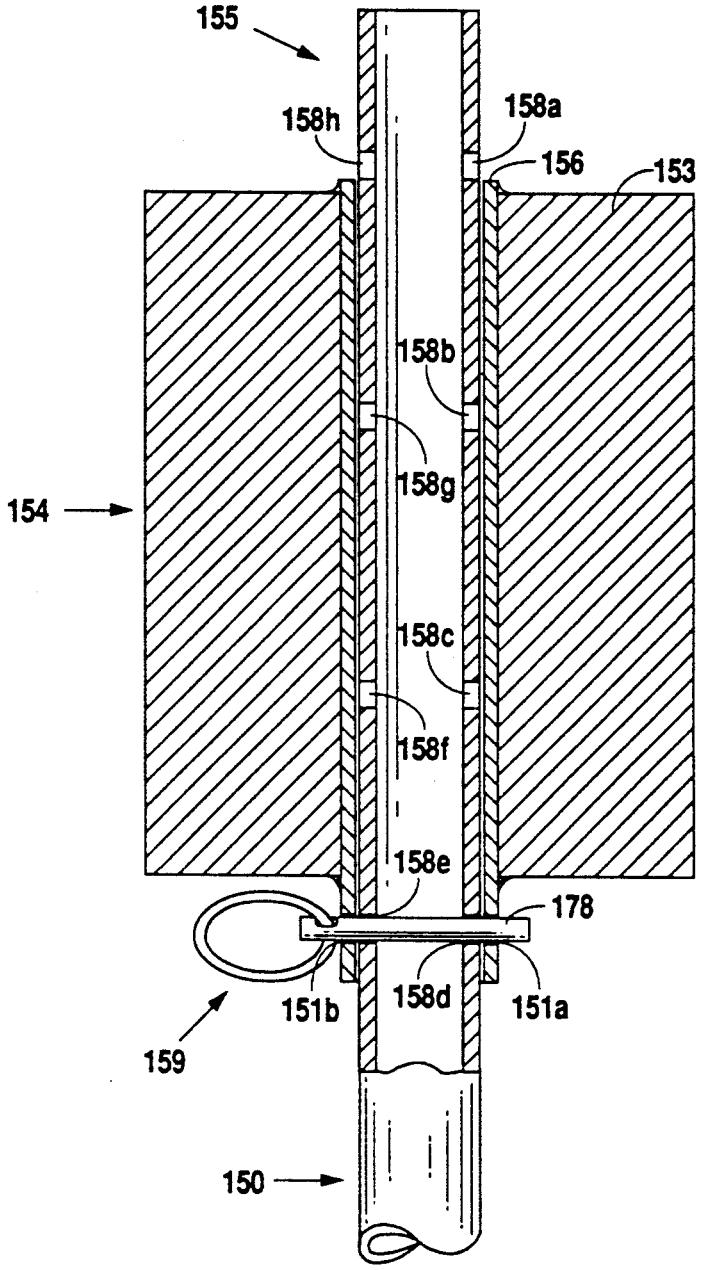
FIG. 8 is partial cross-sectional view of the counter balance connected to the top of the fifth shaft of the swing element.

Referring to FIG. 8, fifth shaft (150) is hollow. Upper end (155) of fifth shaft (150) contains orientation holes (158*a–b*). Orientation hole (158*a*) is directly opposite to orientation hole (158*h*). Orientation hole (158*a*) is directly opposite to orientation hole (158*h*), orientation hole (158*b*) is directly opposite to orientation hole (158*g*), orientation hole (158*c*) is directly opposite to orientation hole (158*f*), and orientation hole (158*d*) is directly opposite to orientation hole (158*e*). Counterbalance (154) is comprised of weighted head (153) welded to hollow shaft (156). Lower section of hollow shaft (156) has alignment holes (151*a–b*). Alignment hole (151*a*) is directly opposite of alignment hole (151*b*). Counterbalance (154) is attached to fifth shaft (150) by sliding hollow shaft (156) over fifth shaft (150) and aligning alignment holes (151*a–b*) with orientation holes (158*a–h*) dependent on the desired position of counterbalance (154). The user experiences more resistance the higher counterbalance (154) is located on shaft (150), thus greater muscle development. Counterbalance (154) is securely attached to shaft (150) by passing shaft (178) of ball lock retaining pin (159) through alignment holes (151*a–b*) of hollow shaft (156) and the chosen set of orientation holes (158*a–b*). In FIG. 8, ball lock retaining pin (159) has secured counterbalance (154) to fifth shaft (150) by aligning alignment holes (151*a–b*) with orientation holes (158*d–e*).

Figure 11:
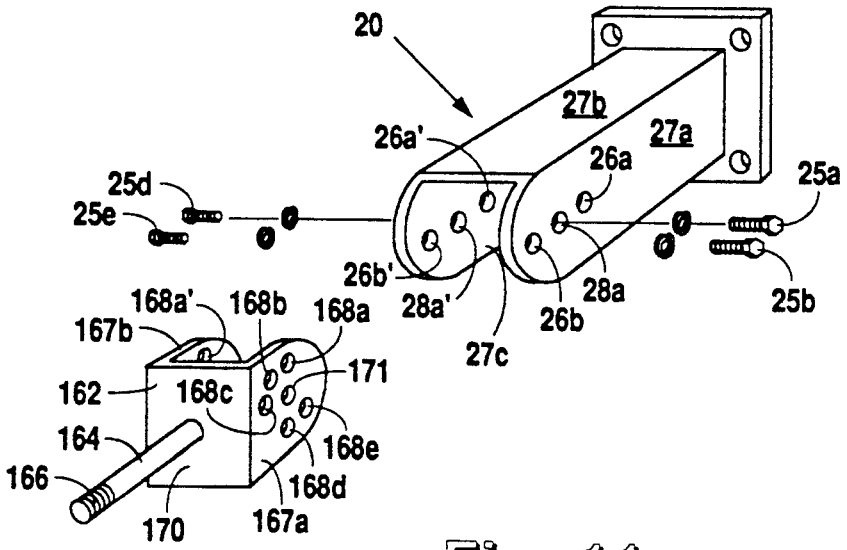
FIG. 11 is an expanded side perspective view of the swing plane adjuster element and extender element of the base element.

Referring to FIGS. 5 and 11 as is necessary for a complete view, swing plane adjuster element (160) is comprised of bolt (164) with threaded end (166) and bracket (162). Bracket (162) has face (170) and sides (167*a–b*). The midpoint of face (170) includes passage (173). Side (167*a*) of bracket (162) has threaded swing plane adjustment passages (168*a–e*) and center pivot passage (171). Side (167*b*) of bracket (162) has threaded swing plane adjustment passages (168*a'–e'*, 168*b'–e'* not shown) and center pivot passage (171'). The alignment of swing plane adjustment passages (168*a–e*) to swing plane adjustment passages (168*a'–e'*) is such that swing plane adjustment passage (168*a'*) on side (167*b*) is directly opposite to swing plane adjustment passage (168*a*) on side (167*a*). Following, swing plane adjustment passage (168*b*) is directly opposite to swing plane adjustment passage (168*b'*), swing plane adjustment passage (168*c*) of side (167*a*) is directly opposite to swing plane adjustment passage (168*c'*) of side (167*b*), swing plane adjustment passage (168*d*) of side (167*a*) is directly opposite to swing plane adjustment passage (168*d'*) of side (167*b*), and swing plane adjustment passage (168*e*) of side (167*a*) is directly opposite to swing plane adjustment passage (168*e'*) of side (167*b*). Center pivot passage (171) of side (167*a*) of bracket (162) is directly opposite to center pivot passage (171') of side (167*b*) of bracket (162). Bolt (164) is fixedly attached to bracket (162) by passing bolt (164) through passage (173) of bracket (162). Bolt (164) is then welded to bracket (162).

Referring to FIG. 5, swing plane adjuster element (160) is pivotally attached to swing element (100) by placing bolt (164) of swing plane adjuster element (160) through sleeve (146). Lock nut (161) is attached to threaded end (166) of bolt (164). This arrangement allows swing element (100) to axillary rotate about bolt (164) of swing plane adjuster element (160). To ensure smooth rotation, nylon bushing (163) is interposed between bolt (164) and the interior side of sleeve (146), nylon thrust washer (165*a*) is interposed between bracket (162) and sleeve (146), nylon thrust washer (165*b*) is interposed between sleeve (146) and metal retainer washer (169), and metal retainer washer (169) is interposed between nylon thrust washer (165*b*) and lock nut (161).

Referring to FIG. 4, bracket (162) of swing plane adjuster element (160) is fixedly attached to extender element (20) of base element (50). Referring to FIG. 11, extender element (20) is comprised of sides (27*a–c*). Side (27*a*) has threaded passages (26*a–b*). Side (27*c*) has threaded passages (26*a'–b'*). The alignment of threaded passages (26*a–b*) of side (27*a*) to threaded passages (26*a'–b'*) of side (27*c*) is such that threaded passage (26*a*) on side (27*a*) is directly opposite to threaded passage (26*a'*) on side (27*c*), and threaded passage (26*b*) on side (27*a*) is directly opposite to threaded passage (26*b'*) on side (27*c*). Side (27*a*) has threaded center pivot passage (28*a*). Side (27*c*) has threaded center pivot passage (28*a'*). The alignment of threaded center pivot passage (28*a*) is such that threaded center pivot passage (28*a'*) is directly opposite to threaded center pivot passage (28*a*).

To obtain the appropriate swing plane which is dependent upon the user's height and club length, extender element (20) is fixedly attached to bracket (162) of swing plane adjuster element (160) by aligning the appropriate threaded swing plane adjustment passages (168*a–e*) with threaded passages (26*a–b*) and threaded swing plane adjustment passages (168*a'–e'*) with threaded passages (26*a'–b'*). For example, if a more vertical swing plane is desired, threaded swing plane adjustment passages (168*e*) would be aligned with threaded passages (26*a*) and threaded swing plane adjustment passages (168*e'*) would be aligned with threaded passages (26*a'*). Regardless of the swing plane required, threaded center pivot passage (28*a*) of extender element (20) is always aligned with center pivot passage (171) of bracket (162) and threaded center pivot passage (28*a'*) is always aligned with threaded center pivot passage (171'). Threaded bolts (25*a–d*) fixedly secure swing plane adjustment element (160) to extender element (20). Lock washers (24*a–d*) complete the fastening. (See FIG. 5) If a less vertical swing plane is desired, threaded passages (26*b*, 26*b*') would be aligned with threaded swing plane adjustment passages (168*c*, 168*c*') respectively. As stated earlier, center pivot passages (28*a*, 28*a*') are always aligned with center pivot passages (171, 171') respectively. Threaded bolts (25*a–d*) fixedly secure swing plane adjustment element (160) to extender element (20). Lock washers (24*a–d*) complete the fastening.

Referring to FIG. 4, extender element (20) is securely attached to height element (30) with threaded bolts (32*a–d*, 32*d* is not shown), passing through extender element holes (21*a–d*, 21*d* not shown) and the appropriate threaded height element holes (31*a–p*). By choosing the appropriate threaded height element holes (31*a–p*), the appropriate height for virtually any size golfer can be obtained.

Height element (30) is secured to base supports (40*a–b*) by passing threaded bolts (41*a–h*) through metal washer (45*a–h*) threaded base support passages (42*a–h*) and threaded passages (43*a–h*). Base supports (40*a–b*) are secured to the ground or other available mounting means by threaded screws (44*a–d*, 44*a* not shown) through threaded mounting passages (46*a–d*, 46*a* not shown). Dependent on the type of mounting means utilized, threaded screws (44*a–d*) can be wood screws, concrete screws, or other fastening materials that may be required.

Convex mirror (90) is fixedly attached to height element (30). The placement of convex mirror (90) is dependent on the height of the golfer. If placed in the appropriate spot on height element (30), the user can view his entire body. This assists the user in assuring his stance is correct and allows the user to watch his body movement throughout his entire swing. Convex mirror (90), although not shown in FIGS. 4A and 4B, could also be used with these alternative embodiments by proper placement on Wall (W) or Pole (P).

Figure 4A:
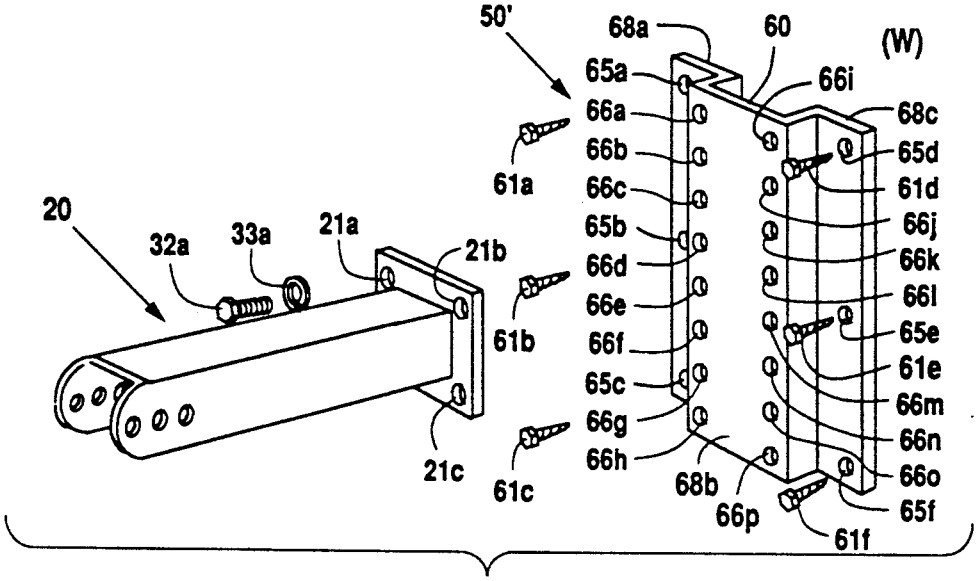
FIG. 4A is an expanded perspective view of the swing plane adjuster element and the base element for the wall mounted version of the golf swing training device.
Figure 4B:
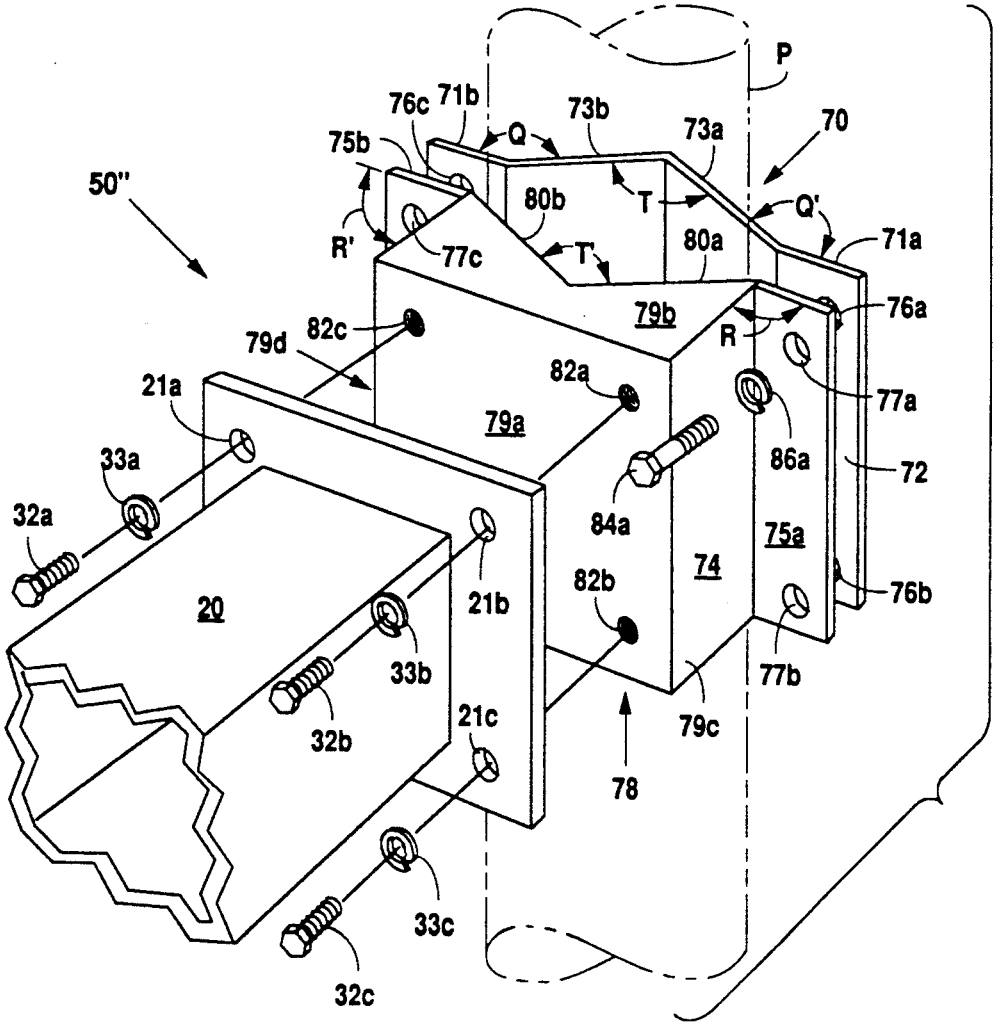
FIG. 4B is a partial cross-sectional expanded perspective view of the swing plane adjuster element and the base element for the pole mounted version of the golf swing training device.

FIG. 4A illustrates an alternative embodiment of base element (50). Base element (50') includes the same extender element (20), as shown in FIG. 4, but includes wall bracket (60) instead of height element (30) and base supports (40*a–b*). Wall bracket (60) has faces (68*a–c*). Face (68*a*) has wall mounting passages (65*a–c*). Face (68*c*) has wall mounting passages (65*d–f*). Wall mounting passage (65*a*) on face (168*a*) is directly opposite to wall mounting passage (65*d*) of face (68*c*), wall mounting passage (65*b*) of face (68*a*) is directly opposite to wall mounting passage (65*e*) of face (68*c*), and wall mounting passage (65*c*) of face (68*a*), is directly opposite to wall mounting passage (65*f*) of face (68*c*). Wall bracket (60) is secured to Wall (W) by passing threaded wall mounting screws (61*a–f*) through the respective wall mounting passages (65*a–f*) and further into Wall (W). Threaded wall mounting screws (61*a–f*) can be wood screws, concrete screws or other mounting tools dependent on the type of Wall (W). Face (68*b*) of wall bracket (60) has threaded mounting passages (66*a–p*). The alignment of threaded mounting passages (68*a–p*) is such that threaded mounting passage (66*a*) is directly opposite to threaded mounting passage (66*i*), threaded mounting passage (66*b*) is directly opposite to threaded mounting passage (66*j*), threaded mounting passage (66*c*) is directly opposite to threaded mounting passage (66*k*), threaded mounting passage (66*d*) is directly opposite to threaded mounting passage (66*l*), threaded mounting passage (66*e*) is directly opposite to threaded mounting passage (66*m*), threaded mounting passage (66*f*) is directly opposite to threaded mounting passage (66*n*), threaded mounting passage (66*g*) is directly opposite to threaded mounting passage (66*o*), and threaded mounting passage (66*h*) is directly opposite to threaded mounting passage (66*p*). Extender element (20) is attached to wall bracket (60) passing threaded bolt (32*a–d*, 32*b–d* not shown) through extender element holes (21*a–d*, 21*d* not shown) and the appropriate threaded mounting passages (66*a–p*) dependent on the user's height. Metal retainer washer (33*a–d*, 33*b–d* not shown) completes the attachment.

FIG. 4B illustrates a third embodiment of base element (50). Base element (50'') includes the same extender element (20) that is shown in FIG. 4A, and includes pole mounting bracket (70) instead of height element (30) and base supports (40*a–b*). Pole mounting bracket (70) has rear mounting bracket (72) and forward mounting bracket (74). Rear mounting bracket (72) is made by bending one sheet of metal to produce two faces (73*a–b*) and two flanges (71*a–b*). Angle (Q) between flange (71*a*) and face (73*a*) is 45 degrees. Angle (Q) between flange (71*b*) and face (73*b*) is 45 degrees. Angle (T) between face (73*a*) and face (73*b*) is 90 degrees. Flange (71*a*) of rear mounting bracket (72) includes threaded securing passage (76*a–b*). Flange (71*b*) of rear mounting bracket (72) has threaded securing passages (76*c–d*, 76*d* not shown). Forward mounting bracket (74) is also made by bending one sheet of metal to produce flanges (75*a–b*) and box (78). Box (78) has forward face (79*a*) and four side faces (79*b–3*, 79*e* not shown). Angle (R) between flange (75*a*) and side face (79*c*) is 90 degrees. Angle (R') between flange (75*b*) and side face (79*d*) is 90 degrees. Flange (75*a*) has securing passages (77*a–b*). Flange (75*b*) has securing passages (77*c–d*, 77*d* not shown). Side face (79*b*) of box (78) has two edges (80*a–b*). Edge (80*a*) meets edge (80*b*) at a 90 degree angle (T'). Side face (79*e*, not shown) has a similar makeup as side face (79*b*). Forward face (79*a*) of box (78) includes threaded mounting passages (82*a–d*, 82*d* not shown). Rear mounting bracket (72) is attached to forward mounting bracket (74) by passing threaded bolts (84*a–d*, 84*b–d* not shown) through metal retainer washers (86*a–d*, 86*b–d* not shown), securing passages (77*a–d*, 77*d* not shown), threaded securing passages (76*a–d*, 76*d* not shown), respectively. The placement of pole mounting bracket (70) about Pole (P) is dependent on the user's height. The taller the user, the higher pole mounting bracket (70) will be attached to Pole (P). Extender element (20) is attached to pole mounting bracket (70) by passing threaded bolts (32*a–d*, 32*d* not shown) through metal retaining washers (33*a–d*, 33*d* not shown), extender element holes (21*a–d*) and threaded mounting passages (82*a–d*, 82*d* not shown), respectively.

The above description merely describes how the golf swing training device (10) was assembled. The forthcoming description will detail how each part or shaft pivots in relationship to its adjacent part.

Figure 9:
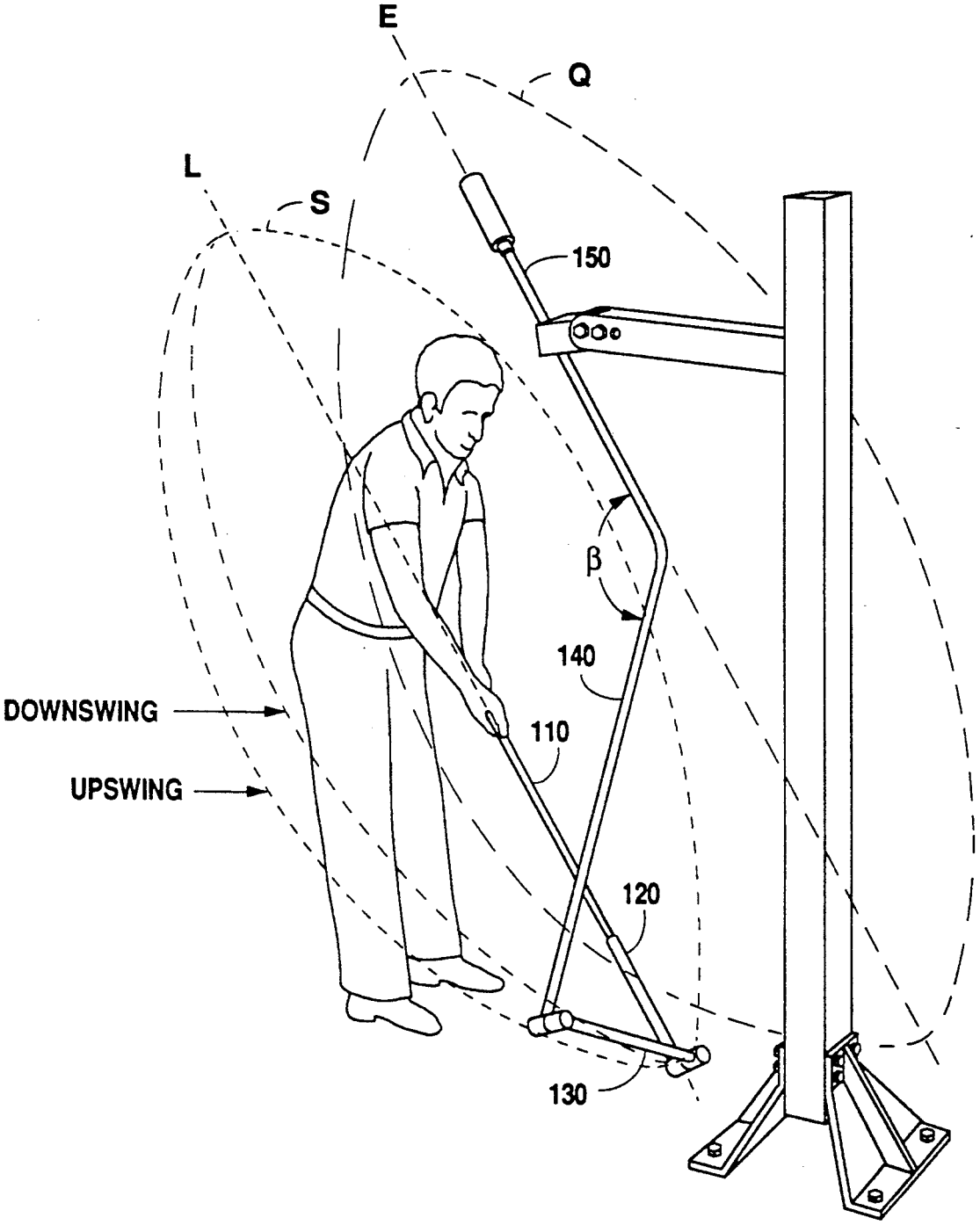
FIG. 9 is a side view of the floor mounted version of the golf swing training device in the starting position.
Figure 10:
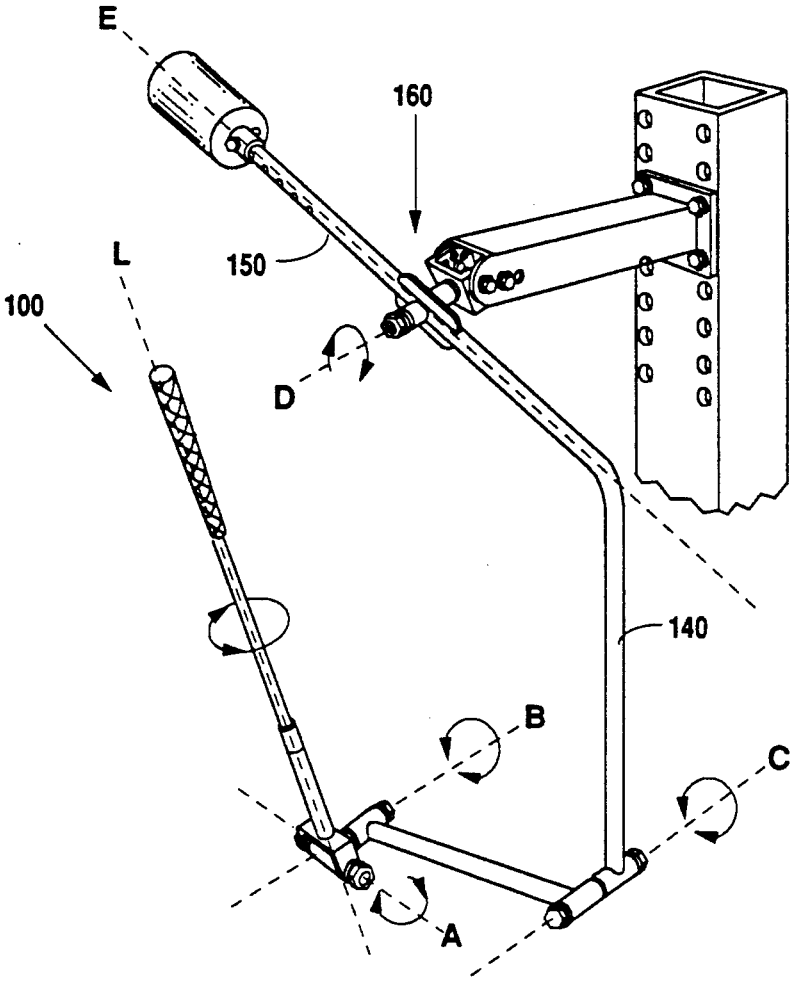
FIG. 10 illustrates the path of rotation of each shaft of the swing element to the adjacent shaft, as well as the rotation of the swing element to the base element.

FIG. 10 illustrates the rotational paths of each interconnected part of golf swing training device (10). As FIG. 9 illustrates, in the starting position, first shaft (110) is concentric to imaginary line (L). Referring back to FIG. 10, second shaft (120) is pivotally connected to first shaft (110) so that second shaft (120) rotates about imaginary line (L). Axis (A) runs concentric to t-shaped head (119) of universal joint (126). Second shaft (120) is pivotally connected to t-shaped head (119) of universal joint (126) so that second shaft (120) rotates about Axis (A). Axis (B) runs concentric to end (131*b*) of third shaft (130). End (131*b*) of third shaft (130) is pivotally connected to universal joint (126) so that end (131*b*) of third shaft (130) rotates about Axis (B). Axis (C) is concentric to lower end (144) of fourth shaft (140). Lower end (144) of fourth shaft (140) is connected to end (131*a*) of third shaft (130), so that lower end (144) of fourth shaft (140) rotates about Axis (C). Axis (D) runs concentric to bolt (164). See also FIGS. 5 and 10. As indicated above, swing element (100) is connected to swing plane adjustment element (160) so that swing element (100) rotates about Axis (D). Axis (B), Axis (C) and Axis (D) are parallel to each other and each is perpendicular to Axis (A). Axis (E) is concentric to fifth shaft (150). When golf swing training device (10) is used and fit properly to the user, swing plane (S) as defined by imaginary line (L) is almost parallel to swing plane (Q) as defined by Axis (E). (See FIG. 9) "Almost" is used to modify parallel due to the offset that occurs by the manner in which third shaft (130) is connected to fourth shaft (140) and universal joint (126). The particular connecting arrangement as discussed earlier is utilized to allow the golf swing training device (10) to track the double elliptical pattern of the entire golf swing without complicated telescoping mechanisms.

Before using the golf swing training device (10), the user must first adjust the golf swing training device (10) for his height and particular swing plane. To adjust for the user's height, the user grasps handle (111) and takes the proper stance, acting as if t-shaped head (119) of universal joint (126) was the club head. See FIG. 9. If the user can not grasp handle (111) appropriately for his stance, then dependent upon the type of base element (50) being used, the user will adjust extender element (20) to the correct position on wall bracket (60), height element (30), or move pole mounting bracket (70) up or down. For example, if the golfer takes the appropriate stance and his hands are too far up on handle (111), extender element (20) should be raised on wall bracket (60) or height element (30), or pole mounting bracket (70) should be moved up the appropriate distance on pole (P).

To adjust the golf swing training device (10) for the proper swing plane (S), threaded bolts (25*b* and 25*d*) are removed, threaded bolts (25*a* and 25*c*) are left in place to secure swing plane adjuster element (106) to extender element (20). User takes the appropriate stance, grasping handle (111) and acting as if t-shaped head (119) of universal joint (126) was the club head and takes several practice swings. After taking several "practice swings", swing plane adjuster element (160) will have moved to a position that traces the natural swing plane of the user. Threaded bolts (25*b*, 25*d*) are replaced through the threaded swing plane adjustment passages (168*a–e*, 168*a'–e'*) that align with threaded passages (26*a–b*, 26*a'–b'*) respectively.

As is evident from the numerous swing planes, golf swing training device (10) is capable of duplicating, if the user is utilizing a swing plane that is too vertical or horizontal. This situation can be corrected using golf swing training device (10) and adjusting it to the proper swing plane for the golfer. Through repetitive use, i.e. muscle memory, the golf swing training device (10) will force the golfer to utilize the proper swing plane when golfing.

FIG. 9 illustrates a user of golf swing training device (10) in the starting position and the path t-shaped head (119) of universal joint (126) tracks throughout the golf swing. As noted above, the hands and club head track two separate arcs during the upswing and downswing, thus two paths are shown for the back swing. Yet, both arcs remain in swing plane (S) which is defined by imaginary line (L). To maintain t-shaped head (119) of universal joint (126) in the proper swing plane (S), first shaft (110), second shaft (120), third shaft (130), and fourth shaft (140) all rotate about the previously mentioned Axis (A), (B), (C) and (D). On the upswing of the back swing, shaft (110) rotates toward user about Axis (L). On the downswing and follow through, first shaft (110) rotates away from the user about Axis (L).

During the upswing, third shaft (130) rotates in a direction toward the user about Axis (B). During the downswing and follow through, third shaft (130) rotates in a direction away from the user about Axis (B). During the upswing, fourth shaft (140) rotates in a direction toward the user about Axis (C). During the downswing and follow through, fourth shaft (140) rotates in a direction away from the user about Axis (C). During the upswing, fifth shaft (150) rotates in a direction towards the user about Axis (D). During the downswing and follow through, fifth shaft (150) rotates in a direction away from the user about Axis (D).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A golf swing training device comprising:

a swing element;

a swing plane adjuster element;

a base element;

said swing element comprising a first shaft pivotally connected to a second shaft, said second shaft pivotally connected to a third shaft by joining means, said third shaft pivotally connected to a fourth shaft, said fourth shaft rigidly connected to a sleeve, said sleeve rigidly connected to a fifth shaft;

said swing plane adjuster element having a shaft element fixedly attached to a bracket element;

said sleeve of said swing element pivotally attached to said shaft element of said swing plane adjuster element; and said bracket element of said swing plane adjuster element rigidly attached to said base element.

2. The apparatus of claim 1 wherein said second shaft is hollow with an upper end and lower end, said lower end being bracketed;

said first shaft having an upper end, midsection and lower end, said lower end of said first shaft being positioned inside said upper end of said second shaft, said lower end of said first shaft being maintained inside said upper end of said second shaft by restraining means fixedly attached to said lower end of said first shaft and second restraining means fixedly attached to said midsection of said first shaft, such that said first shaft rotates within said second shaft about a common axis;

said joining means pivotally connecting said second shaft to said third shaft being a universal joint having a t-shaped hollow head and threaded shaft;

said t-shaped hollow head being pivotally connected to said bracketed end of said second shaft, such that said t-shaped hollow head defines a second axis A, said third shaft having two hollow, barrel shaped ends, said first end being pivotally attached to said threaded shaft of said universal joint, such that said threaded shaft of said universal joint defines a third axis B;

said forth shaft having one hollow, barrel shaped end and one flanged end, said hollow, barrel shaped end of said forth shaft being pivotally connected to said second hollow, barrel shaped end of said third shaft, said flanged end of said forth shaft being fixedly connected to said sleeve, such that said hollow, barrel shaped end of said forth shaft and said hollow, barrel shaped end of said third shaft define a fourth axis C;

said shaft element of said swing plane adjuster element defining a fifth axis D about which said swing element rotates; and said fifth shaft having at least one hollow end and one flanged end, said flanged end fixedly connected to said sleeve such that said fifth shaft defines a sixth axis E about which a swing plane Q rotates.

3. The apparatus of claim 2 wherein said fourth shaft has an upper and a lower portion, said upper portion concentric to said sixth axis E, said lower portion bent in relationship to said upper portion at approximately a 130–150 degree angle, said lower portion offset approximately 15 degrees from said plane Q.

4. The apparatus of claim 3 further comprising a weight means movably connected to said fifth shaft for assuring the follow through is completed and to build the muscles required in golf.

5. The apparatus of claim 4 wherein said base element comprises:

an extender element movably attached to a height element;

said height element fixedly attached to a mounting element;

said extender element having a bracket element with a forward portion and a rear portion, said rear portion of bracket element being fixedly attached to a fastening element, said fastening element having a plurality of threaded adjustment holes;

said bracket element having three sides, each of said sides being attached to the adjacent side at a 90 degree angle to form a cavity, said first side and said third side having a plurality of threaded adjustment holes; and said height element being a rectangular shaft with four faces, each of said faces having an upper portion and a lower portion, said upper portion of said first face having a plurality of threaded adjustment holes corresponding to said plurality of threaded adjustment holes of said fastening element of said extender element.

6. The apparatus of claim 5 wherein said mounting element is comprised of two reinforced brackets;

said first reinforced bracket fixedly attached to said lower portion of said second face of said height element; and said second reinforced bracket fixedly attached to said lower portion of said third face of said height element.

7. The apparatus of claim 4 wherein said base element comprises:

an extender element moveably attached to a wall mounting element;

said extender element having a bracket element with a forward portion and a rear portion, said rear portion of bracket element fixedly attached to a fastening element, said fastening element having a plurality of holes; and said bracket element having three sides, each of said sides being attached to the adjacent side at a 90 degree angle to form a cavity, said first side and said third side having a plurality of threaded adjustment holes.

8. The apparatus of claim 7 wherein said wall mounting element is a bracket with a plurality of threaded adjustment holes corresponding to said plurality of threaded adjustment holes of said fastening element of said extender element.

9. The apparatus of claim 4 wherein said base element comprises:

an extender element fixedly attached to a pole mounting element;

said extender element having a bracket element with a forward portion and a rear portion, said rear portion of bracket element being fixedly attached to a fastening element, said fastening element having a plurality of threaded adjustment holes; and said bracket element having three sides, each of said sides being attached to the adjacent side at a 90 degree angle to form a cavity, said first side and said third side having a plurality of threaded adjustment holes.

10. A golf swing training device comprising:

a swing element fixedly attached to a swing plane adjuster element;

said swing plane adjuster element fixedly attached to a base element;

said swing element comprising a first shaft pivotally connected to a second shaft, said second shaft pivotally connected to a third shaft by joining means, said third shaft pivotally connected to a fourth shaft, said fourth shaft rigidly connected to a sleeve, said sleeve rigidly connected to a fifth shaft;

said swing plane adjuster element having a shaft element fixedly attached to a bracket element;

said sleeve of said swing element pivotally attached to said shaft element of said swing plane adjuster element;

said base element having an extender element;

said bracket element of said swing plane adjuster element moveably attached to said extender element of said base element;

said second shaft being hollow with an upper end and lower end, said lower end being bracketed;

said first shaft having an upper end, midsection and lower end, said lower end of said first shaft being positioned inside said upper end of said second shaft, said lower end of said first shaft being maintained inside said upper end of said second shaft by restraining means fixedly attached to said lower end of said first shaft and second restraining means fixedly attached to said midsection of said first shaft, such that said first shaft rotates within said second shaft about a common axis;

said joining means pivotally connecting said second shaft to said third shaft being a universal joint having a t-shaped hollow head and threaded shaft;

said t-shaped hollow head being pivotally connected to said bracketed end of said second shaft, such that said t-shaped hollow head defines a second axis A, said third shaft having two hollow, barrel shaped ends, said first end being pivotally attached to said threaded shaft of said universal joint, such that said threaded shaft of said universal joint defines a third axis B;

said forth shaft having one hollow, barrel shaped end and one flanged end, said hollow, barrel shaped end of said forth shaft being pivotally connected to said second hollow, barrel shaped end of said third shaft, said flanged end of said forth shaft being fixedly connected to said sleeve, such that said hollow, barrel shaped end of said forth shaft and said hollow, barrel shaped end of said third shaft define a fourth axis C;

said shaft element of said swing plane adjuster element defining a fifth axis D about which said swing element rotates;

said fifth shaft having at least one hollow end and one flanged end, said flanged end fixedly connected to said sleeve such that said fifth shaft defines a sixth axis E about which a swing plane Q rotates; and said fourth shaft having an upper and a lower portion, said upper portion concentric to said sixth axis E, said lower portion bent in relationship to said upper portion at approximately a 130–150 degree angle, said lower portion offset approximately 15 degrees from said plane Q.

* * * * *